United States Patent [19]

Daniels et al.

[11] 4,120,578

[45] Oct. 17, 1978

[54] CONTINUOUSLY VARIABLE REDUCTION SCANNING OPTICS DRIVE

[75] Inventors: Raymond Alex Daniels; David Kent Gibson; Paul Kummli, all of Boulder; Spencer Allan Snell, Lyons; Michael Henry Ulrich, Boulder, all of Colo.

[73] Assignee: International Business Machines Corporation, Armonk, N.Y.

[21] Appl. No.: 721,124

[22] Filed: Sep. 7, 1976

[51] Int. Cl.[2] ..... G03G 15/28

[52] U.S. Cl. ..... 355/8; 355/57; 355/58

[58] Field of Search ..... 355/8, 11, 55–62; 358/285, 287

[56] References Cited

U.S. PATENT DOCUMENTS

| | | | |
|---|---|---|---|
| 2,927,503 | 3/1960 | Zollinger | 88/24 |
| 3,076,392 | 2/1963 | Cerasani et al. | 95/1.7 |
| 3,395,610 | 8/1968 | Evans et al. | 88/24 |
| 3,542,467 | 11/1970 | Ferguson et al. | 355/60 X |
| 3,614,222 | 10/1971 | Post et al. | 355/8 |
| 3,640,615 | 2/1972 | Schaeffer | 355/8 |
| 3,897,148 | 7/1975 | Ritchie et al. | 355/58 X |
| 3,998,540 | 12/1976 | Weinstein | 355/8 |
| 4,007,986 | 2/1977 | Komori et al. | 355/57 |
| 4,029,409 | 6/1977 | Spinelli et al. | 355/8 X |

FOREIGN PATENT DOCUMENTS

| | | | |
|---|---|---|---|
| 967,796 | 5/1975 | Canada | 355/55 |

*Primary Examiner*—A. D. Pellinen
*Attorney, Agent, or Firm*—Charles E. Rohrer

[57] ABSTRACT

A continuously variable reduction scanning optical system wherein a preferred embodiment is disclosed with mechanisms for continuously adjusting the magnification ratio, the total conjugate length, scan speed, scan length, and leading edge registration. Either a single focus or variable focus lens can be used.

24 Claims, 14 Drawing Figures

CONTINUOUSLY VARIABLE REDUCTION SCANNING OPTICS DRIVE

This invention relates to document copier machines and more particularly to document copiers with the capability of reducing the size of document copies in a continuously variable manner. A related patent application is Ser. No. 721,125; filed Sept. 7, 1976.

BACKGROUND OF THE INVENTION

Various document copier machines have been produced with the capability of reducing the size of copies made from the documents placed on the document glass. Most of these machines, however, have been designed for providing specific discrete reduction ratios, e.g., of 0.75:1 or 0.66:1. Rarely has an attempt been made to provide a document copier with the capability of continuously variable reduction from ratios such as 1:1 to another ratio such as, e.g., 0.647:1. The few attempts that do appear in the prior art, e.g., U.S. Pat. No. 2,927,503 to Zollinger, and U.S. Pat. No. 3,395,610 to Evans, have operated with a flash exposure, rather than a scanning optical system. It is, therefore, an object of this invention to provide the advantages of a scanning system in a continuously variable reduction document copier machine.

Most conventional non-reduction copy machines utilize a rotating photoconductor-bearing drum with a scanning optical system in order to realize economies over a full-exposure system which must necessarily use a flat imaging surface which is mechanically more complex and consumes more space than a simple rotating drum. Additionally, full-exposure systems have higher power requirements to operate document illumination equipment and can temporarily blind a machine operator if the flash is eye observed. Despite these disadvantages, in reduction optics, most prior art systems opt for the full-exposure procedure to take advantage of the simplicity of its concept. For example, one of the complexities of a scan system utilized in a reduction machine is changing the velocity of the scanning carriages relative to the surface velocity of the rotating drum. Such systems exist in the prior art, exemplified by U.S. Pat. Nos. 3,614,222; 3,897,148 and 3,542,467; but those systems are limited to two, three and five discrete reduction ratios respectively, and therefore only two, three or five ratios of velocities. It is, therefore, an object of this invention to provide a drive system for scanning carriages which adjusts the speed of the scan in a continuously variable manner between boundaries.

In addition to the change of scan velocity, in a reduction system, the length of the scan must also change relative to the length of the image laid down on the photoconductor. For example, at 1:1, an 11-inch document is scanned into an 11-inch image area, but at a 0.647 reduction, a 17-inch document is scanned into the same 11-inch area. Thus it is a further object of this invention to adjust the length of scan relative to the length of the image in a continuously variable manner between boundaries.

A significant problem arises in a reduction scan system involving leading edge registration of the image to the image area. It is desirable for mechanical and timing reasons to match the leading edge of the copy paper to the leading edge of the image area. Therefore, if both the document and the copy paper are $8\frac{1}{2} \times 11$ inches, it is necessary to place the leading edge of the image at the leading edge of the image area in order to transfer the entire image to the copy paper. Also, if a document of 17-inch size is placed on the document glass, it must still be squeezed into an 11-inch image area for transfer to an $8\frac{1}{2} \times 11$-inch sheet of copy paper. Therefore, unless overreduction is practiced, the leading edge of the image of the reduced document must also fall on the leading edge of the image area. However, in a scanning system, as already noted, the scan velocity changes relative to the peripheral velocity of the image area on the photoconductor drum for various reduction ratios. Therefore, the scanning carriage starting position must be shifted in time or space so that it begins to scan the document at the same position on the photoconductive surface regardless of scan speed. Consequently, a further object of this invention is to adjust the leading edge of the scan in a continuous manner with the change in reduction ratio such that the leading edge of the image always falls on the leading edge of the image area.

According to optical theory, a reduction ratio calls for a lens position closer to the image than to the object. However, if a lens is shifted from a 1:1 copying position to a reduction ratio, the plane of the image sharpness also shifts (assuming a constant object plane). Therefore, a problem arises for reduction document copier machines where it is desirable to maintain both a stationary object plane and a stationary image plane, as well as maintain image sharpness. This problem has been approached in discrete reduction systems by providing "add" lens at a particular setting to change the focal length of the lens or by rotating a completely new and different lens into place. Obviously, neither of these approaches can be used if a continuously variable system is desired. U.S. Pat. No. 3,395,610 to Evans, mentioned above, apparently attacks the problem by moving a mirror to the center of the larger document, thus establishing a total conjugate length from document to image, and then adjusting the position of the lens to achieve focal sharpness. This approach results in overreduction of the document and therefore limits the range of usable reduction ratios. Therefore, it is another object of this invention to provide a continuously variable reduction ratio in a machine with stationary object and image planes while maintaining focal sharpness regardless of the magnification ratio selected, to produce document images which are not overreduced.

SUMMARY OF THE INVENTION

Briefly stated, this invention is a continuously variable imaging system for an electrophotographic copier machine wherein scanning optics are utilized for directing the illumination from a document plane to an image plane. p More specifically, in a preferred embodiment, the system is used in a document copier with a stationary document plane and a stationary image plane; it makes use of scanning carriages operating at different speeds to maintain the total conjugate length of a system during scan; it makes use of a positioning drive to make adjustments to the relative position of the scanning carriages prior to scan in order to set total conjugate length in a continuously variable manner for various reduction ratios; it makes use of a positioning drive for locating a fixed focus lens for continuously variable magnification and for adjusting the position of the leading edge to a constant location on the image plane, regardless of magnification ratio; it makes use of an optics drive system which provides a speed and length of scan which are continuously variable dependent upon the setting of the magnificaiton ratio; and all adjustments are tied together into an optics positioning system under the control of the machine operator.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

A. In General

Figure 1:
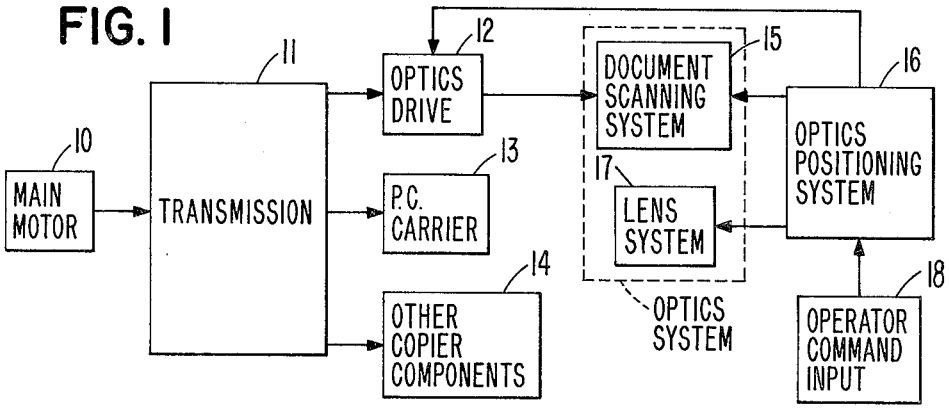
FIG. 1 shows a block diagram of the major components of the document copier.

FIG. 1 shows a block diagram of a preferred embodiment of the invention wherein a main motor 10 is connected through transmission 11 to the optics drive 12, to the photoconductor carrier 13 (which may be a drum or a belt, for example), and to other major copier components 14. The optics drive 12 is connected to the document scanning system 15 to drive scanning carriages across the surface of documents to be copied. An optics positioning system 16 positions the lens 17, provides for total conjugate length correction, positions the document scanning system 15, and positions the optics drive 12 prior to the start of scan in order to adjust the various parameters for continuously variable reduction. The optics positioning system 16 is under the control of an operator command shown at 18.

In the typical electrophotographic copier machine, of either the plain paper or coated paper type, a document to be copied, typically of rectangular shape, is placed on a glass platen. In several prior art machines, the document has been centered along a reference edge, whereas, in other prior art machines, the document has been placed in a corner of the document glass. However the document is positioned, a scanning carriage may be located under the document glass and moved across the under surface of the document, exposing the document with a moving line of light from one end to the other. This moving line of light is directed through an optical system, including a lens, to a photoconductor carrier which is hereafter described as a rotating drum, the surface of which (in plain paper copiers) is comprised of photodetecting material carrying electrical charge. Obviously, the speed of the scan and the speed of the drum must be matched in a particular ratio, e.g., at a 1:1 ratio the speed of the scan and the peripheral speed of the drum must be the same. The result of the scan is that an electrophotographic latent image of the document is produced on the photodetector. This latent image is then passed through a developer station in which toner material is deposited on the latent image, causing the toner to adhere to certain areas of the photodetector and not to others, depending upon whether light has been transmitted to the drum discharging the electrical charge thereon. In plain paper copiers, the developed image is then passed through a transfer station where the image is transferred to a copy paper sheet. The copy paper is then passed to a fusing station for heating the transferred toner to cause it to permanently affix to the copy sheet. Meanwhile, the drum continues to rotate through a cleaning station where residual toner is removed from the surface of the drum prior to beginning the next copy cycle.

In coated paper copiers, the same basic operation occurs except that the photoconducting material is located on the copy paper itself. Therefore, the speed of scan and the speed of the copy paper during image exposure must be matched in the appropriate ratio for the amount of reduction selected. Of course, a positive image must be produced on the coated paper as opposed to a negative image on the photoconductor in a plain paper copier.

In typical electrophotograhic plain paper copier machines, the leading edge of the copy paper must be brought into juxtaposition with the drum at the transfer station to coincide with the leading edge of the image area. If the document is to be copied at 1:1 ratio onto a copy sheet of exactly the same size, it is also necessary to provide the leading edge of the document image at the leading edge of the image area so that the entirety of the document can be transferred to the copy sheet. This is obviously the case where $8\frac{1}{2} \times 11$-inch documents are copied onto $8\frac{1}{2} = 11$-inch copy paper. Typical document copiers, such as the IBM Copier II or Series III, provide the necessary mechanisms for timing the relationship of copy paper leading edge to image area in order to provide this function.

Figure 2A:
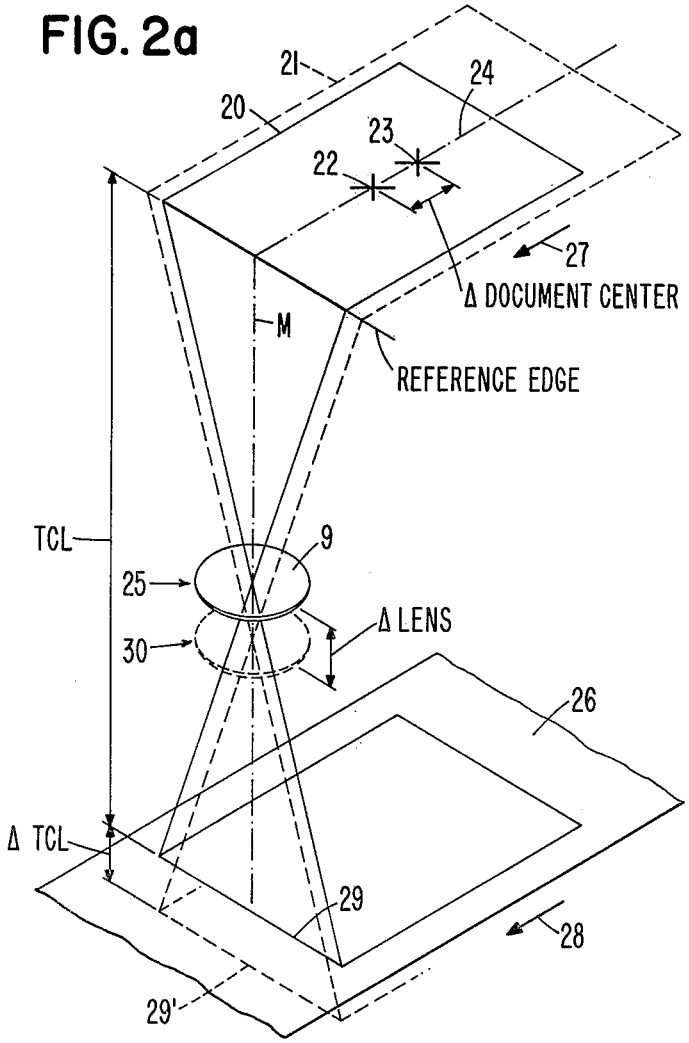
FIG. 2*a* shows an unfolded ray trace of an imaging system to demonstrate the changes in lens position and in the plane of image sharpness for two magnification ratios.
Figure 2B:
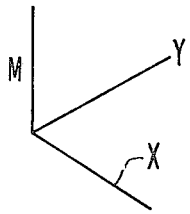
FIG. 2*b* shows orthogonal axes for reference in FIG. 2*a*.

FIG. 2*a* is an illustration of what must take place when documents of different sizes are to be copied upon the same size copy paper. In FIG. 2*a*, a first document 20 is shown positioned at a reference edge along its center. Similarly, a second rectangular document 21, larger in size than document 20, has been shown positioned along the same reference edge at its center. It should be noted that the center point 22 of document 20 and the center point 23 of document 21 lie along a common center line 24, but are not coincident with one another. A lens 9 is positioned at 25 midway between the document or object plane containing document 20 and an image plane 26 containing the photoreceptive material. By positioning the lens thusly, according to well-known optical principles, the size of the object 20 will be reproduced to the same size at the image plane 26. Thus, in a scanning system, if a line of light is laid down along the reference edge, and document 20 is moved as shown by the arrow 27, an image of document 20 will be laid upon the photoreceptor 26 where the photoreceptor is moved in the direction 28 at a speed which matches the speed of the document scan. A line of light along the reference edge being directed through the lens at position 25 is shown on the photoreceptor 26 at 29. The ray trace shown illustrates that the length of line 29 corresponds to the length of the edge of document 20 along the reference edge.

Should it be desired to copy the larger document 21 onto the same size copy paper as was used for document 20, it is obvious that the edge of document 21 along the reference edge must be reduced at least to the dimension of line 29 on the image plane. The formula for movement of lens in order to gain a reduction of the size of the image calls for moving the lens closer to the image plane along the magnification (optical) axis of the system. The amount of movement (for a thin lens) is determined by the equation:

$$\Delta\text{lens} = f(1 - m)$$

where $f$ is the focal length of the lens and $m$ is the reduction ratio. In the present illustration, $m$ may be found by dividing the length of the line 29 by the length of the edge of document 21 along the reference edge.

FIG. 2a shows a representation of the movement of the lens 9 from position 25 to a position 30. A ray trace has been drawn from the edges of the document 21 through the lens at position 30 to the image plane. Note, however, that the ray trace passes through the plane of line 29 to some distance below that plane where line 29' is formed to exactly the same size as line 29. The optical phenomenon involved is simply that the plane of focal sharpness of the reduced image is moved beyond the plane of the original image. The distance by which the total conjugate length (the distance between object and image planes) changes is shown in FIG. 2a by ΔTCL. Thus, if focal sharpness is to be maintained, the photoreceptor must be dropped into a new and different plane for each and every reduction ratio. Obviously, practical copy machines generally provide stationary object and image planes and therefore the change in TCL must be provided through other means. Some solutions to this problem include (1) substitution of a new lens with a different focal length and (2) the bringing in of an "add" lens which effectively changes the focal length of the first lens. Both of these solutions would allow for the use of a direct optical system if desired, such as shown in FIG. 2a, but would not admit of a continuously variable reduction system such as the present invention. As will be explained below, the system of this invention provides mirrors to fold the optical path in a manner that enables the continuous adjustment of the mirror and therefore the TCL to whatever length is needed. The thin lens formula for the change in TCL is:

$$\Delta\text{TCL} = -f(2-m - (1)/m)$$

While FIG. 2a has illustrated the magnification and image sharpness principles in a document scan system (moving document), these principles are the same for a line scan system, where the document is stationary and the line of light is moved across the document.

B. A First Preferred Embodiment

Figure 3:
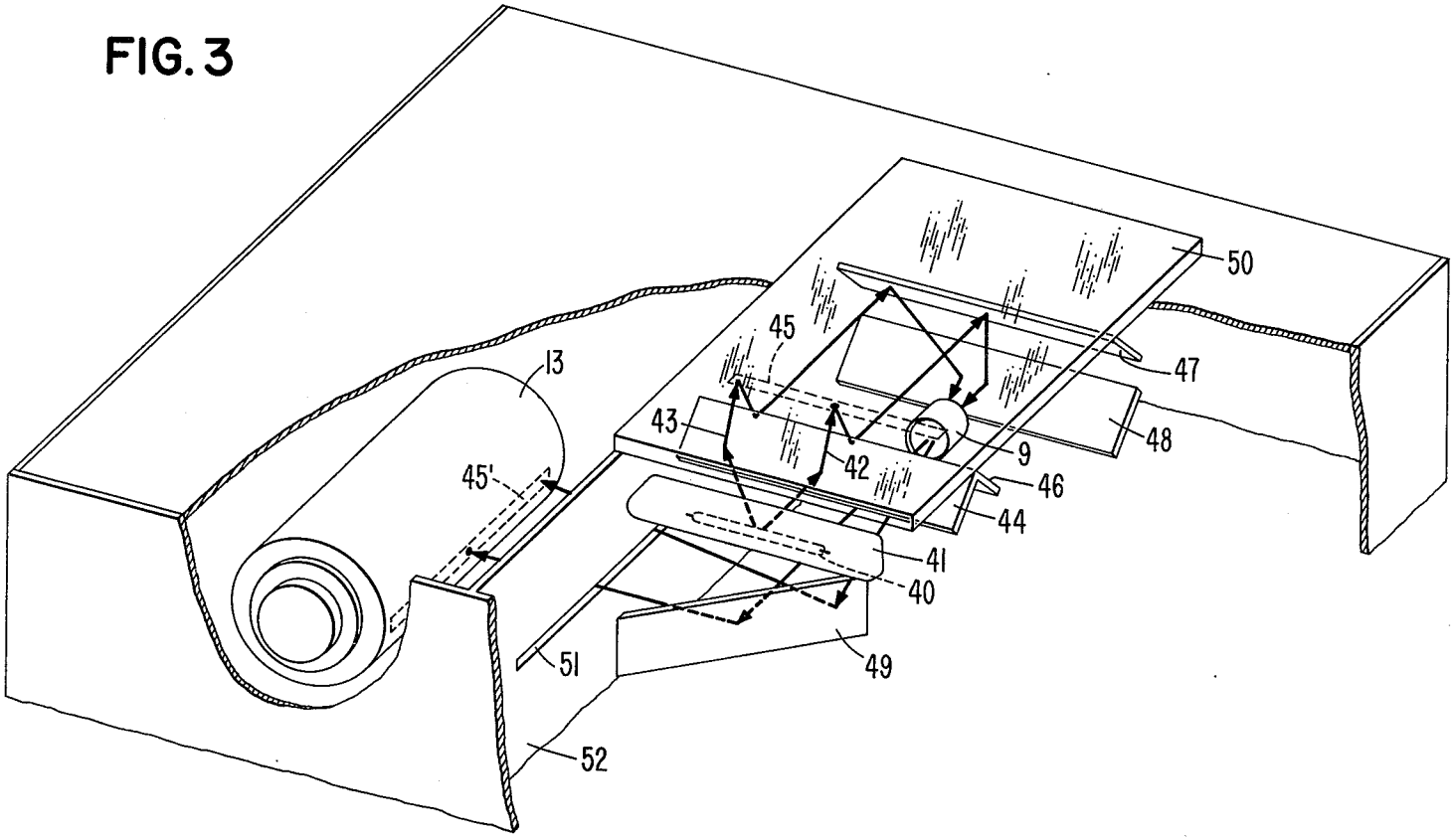
FIG. 3 is an overall perspective of the folded optical system in use in the preferred embodiment of the invention.

FIG. 3 is an overall view of a copy machine constructed according to a preferred embodiment of the instant invention illustrated generally in FIG. 1, showing the path taken by a ray of light from a document glass through the optical system to the photoconductor drum. A cylindrical bulb 40 is shown partially surrounded by a reflector 41 for producing light rays, two of which are shown at 42 and 43. Ray 42 is drawn along the optical axis of the system, i.e., the axis of the light directed from the document plane (horizontal plane containing line of light 45 on glass platen 50) to the image plane (vertical plane containing the line of light 45' on photosensitive drum 13). Ray 42 emanates from the bulb 40 and is directed onto a dichroic mirror 44 which separates the visible spectrum from infrared radiation. From the dichroic mirror, the visible spectrum is reflected upwardly to the document glass 50 as part of a line of light 45. Ray 42 is then directed downwardly to a mirror 46 across to other mirrors 47 and 48 through the lens 9 to a fourth mirror 49 through an opening 51 to a photosensitive drum 13 thereon forming part of an image line 45'. The ray 43 follows a path similar to ray 42 also producing on the drum part of the line of light 45'.

Figure 5:
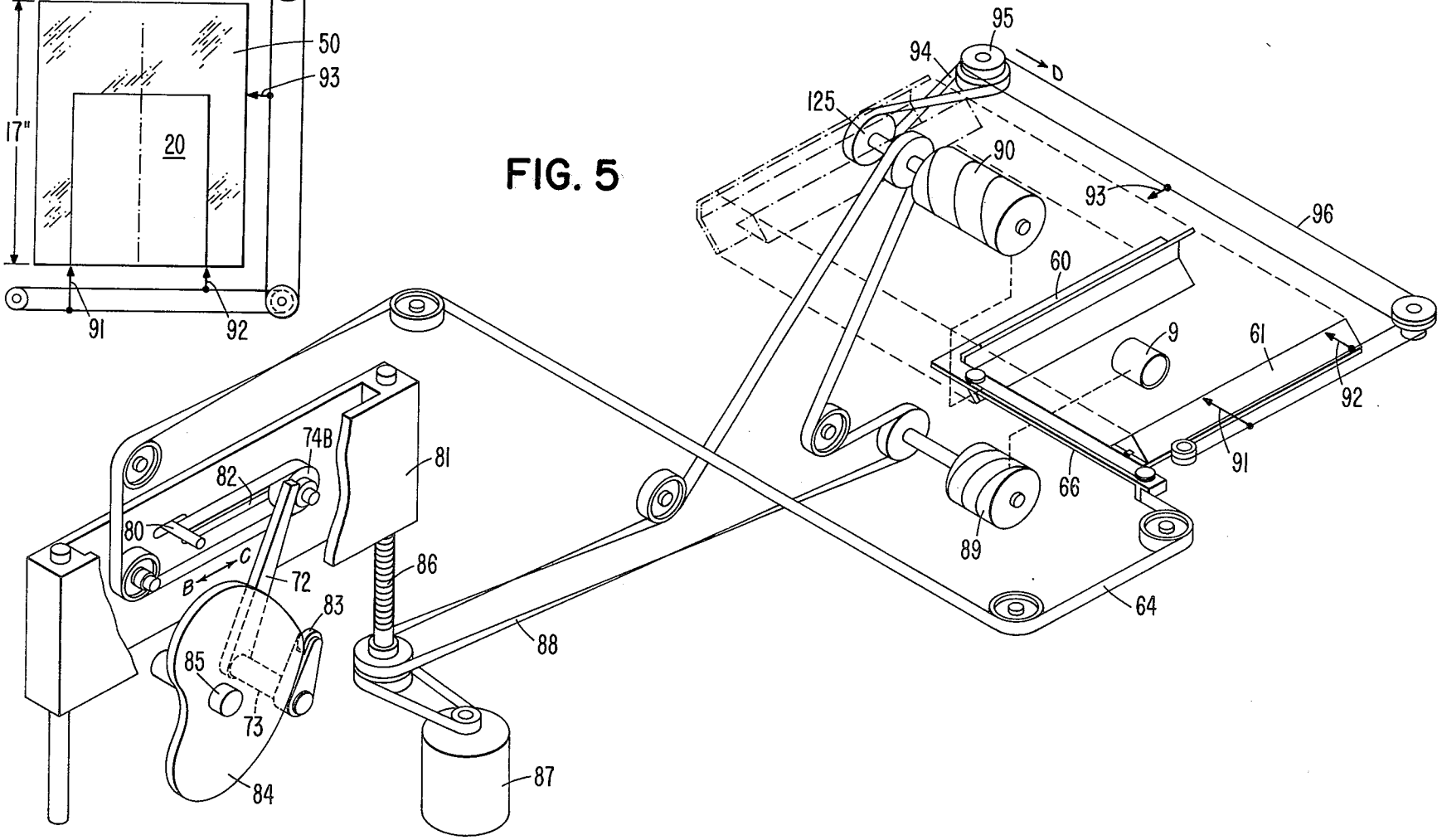
FIG. 5 is a simplified diagrammatic perspective of the optical positioning system together with the optical drive system.

Note that the opening 51 is formed in an interior wall 52, which wall separates the optics system from the remainder of the machine. Within the optics system is the document glass 50, the document scanning system 15 and the lens system 17. In another part of the machine, photosensitive drum 13 is located, and in still another part, not shown in FIG. 3, the optical drive system is found. The optical positioning system is found partly with the optics system and partly with the optical drive system as shown in FIG. 5, discussed below.

Figure 4:
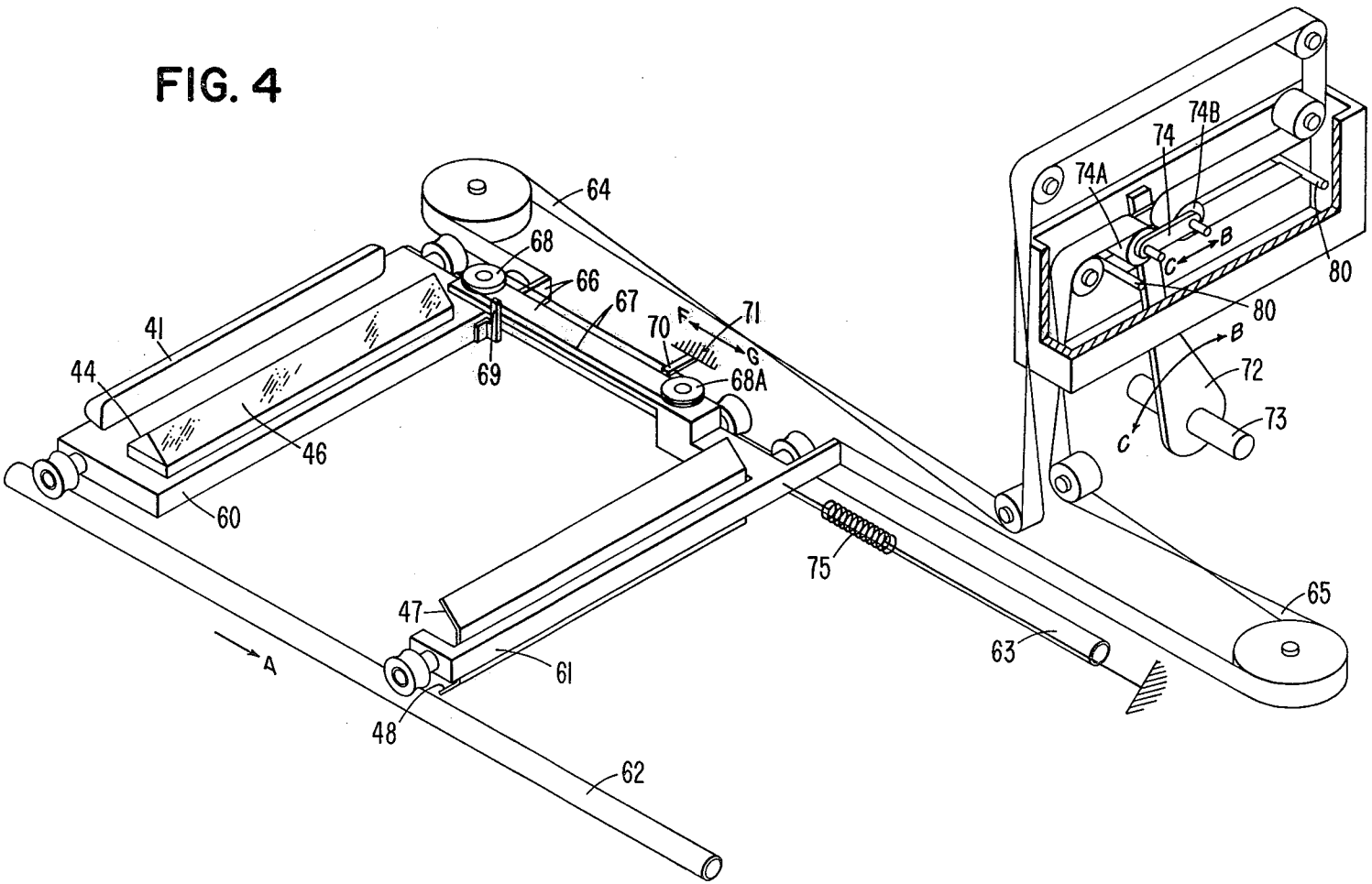
FIG. 4 shows a diagrammatic perspective of the two scanning carriages and the manner in which they are moved.

In FIG. 4 there is shown a diagrammatic perspective of two scanning carriages 60 and 61 which move across the document glass 50 to move the line of light 45 from one end of the document glass to the other. As shown in FIG. 4, scanning carriage 60 carries the source of illumination and its reflector 41, together with the dichroic mirror 44 and the first reflecting mirror 46. Scanning carriage 61 carries two mirrors 47 and 48 which receive light from carriage 60 and bend it by 180° to send it through lens 9 as shown best in FIG. 3. The two scanning carriages are mounted for movement along parallel rails 62 and 63 and are driven by a two-piece drive belt 64 and 65. Drive belt 64 is connected to an arm 66 of the carriage 61, while belt 65 is connected to carriage 61 at the opposite end of arm 66. Obviously, any suitable arrangement of drive cables, including a one-piece cable and/or an open loop cable could be used. The drive belts are looped around pulleys 74A and 74B, located on a drive carriage 74, and are fastened to an adjustable grond point 80, the significance of which is explained below in the section entitled, "Leading Edge Adjustment."

An endless cable 67 passes around pulleys 68 and 68A which are mounted on arm 66. Carriage 60 is attached to endless cable 67 by clamp 69. Note that endless cable 67 is clamped at 70 to a movable ground point 71. The significance of the movable ground will be explained below in the section entitled, "The TCL Adjustment."

Note that if drive belts 64 and 65 move scanning carriage 61 in direction A, the scanning carriage 60 will move at twice the speed of carriage 61 because of the velocity multiplying arrangement in which cable 67 is clamped to ground point 71. Thus, a system is provided in which the slower moving carriage is the directly driven carriage while the faster moving carriage is driven through a motion multiplier from the driven slower moving carriage. The significance of moving one of the scanning carriages at twice the speed of the other will be explained below in the section entitled, "Keeping the TCL Constant During Scan."

The manner in which driven carriage 61 is moved is shown in FIG. 4 to be from a drive arm 72 which is rotated by shaft 73. As drive arm 72 is moved in a reciprocating manner, in the direction of arrow B, drive carriage 74 is moved in direction B. Since drive cables 64 and 65 are connected by pulleys 74A and 74B to opposite ends of drive carriage 74, motion of drive arm 72 in direction B causes the two scanning carriages to move in direction A. The spring 75 exerts a biasing force on the system, such that the drive carriage 74 is always biased against the drive arm 72. Thus, as movement occurs in the direction B, a tensioned spring 75 exerts the force to bring the carriages in direction A and maintain drive carriage 74 against the drive arm 72. When the reciprocating arm returns in direction C, the spring 75 is retensioned.

FIG. 5 shows a cutaway view of the drive system and also provides a diagrammatic representation of the optics positioning system. Carriages 60 and 61 are shown together with cable 64 connected to arm 66. For simlicity, drive cable 65 has been deleted. Cable 64 is shown passing around a pulley 74B on drive carriage 74 to a movable ground point 80 (only pulley 74B of drive carriage 74 is shown in FIG. 5). Cable 65 (not shown) is also connected to drive carriage 74 around pulley 74A (not shown) and from there to adjustable ground point 80. Drive carriage 74 is mounted in a truck 81, and in the diagrammatic representation shown here, slots have been cut into truck 81, one of which is shown at 82, for supporting the drive carriage 74 and allowing it to move in the directions B and C under the influence of drive arm 72. Drive arm 72 is connected by shaft 73 to cam follower 83 which follows drive cam 84. Cam 84 is driven by shaft 85 which is connected by a transmission to the main motor (shown in FIG. 1).

Truck 81 is positioned in a continuously variable manner along lead screw 86 by optics positioning motor 87. Motor 87 also drives positioning cable 88 which turns the optics cam 89 and the focal sharpness cam 90, the latter cam provided for adjusting total conjugate length. Thus, it is seen that through cable 88, the magnification ratio and the total conjugate length are tied together for simultaneous adjustment. Also, it should be noted that the truck 81 is adjusted simultaneously with the lens and TCL cams so that the position of drive carriage 74 along drive arm 72 is altered accordingly. The significance of the change in the position of drive carriage 74 will be discussed below.

Figure 5A:
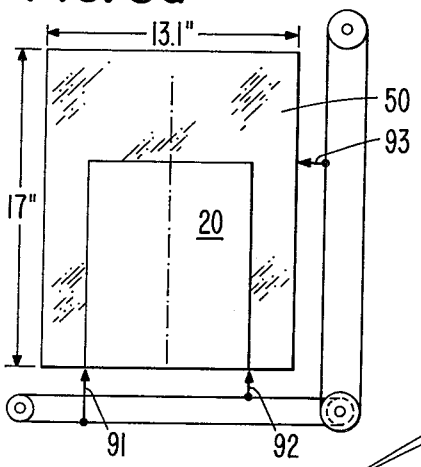
FIG. 5*a* shows the document glass with positioning indicators.

FIGS. 5 and 5*a* also show the system for feeding back information to the operator to inform him when the optics positioning system is adjusted properly. The document is positioned on the document glass in the manner shown in FIG. 5*a* along the center of the reference edge. Positioning indicators 91 and 92 are moved simultaneously by the operator to encompass the outer edges of the document. At the same time, positioning indicator 93 is moved to encompass the document along a second dimension. By observing the position of the indicators 91, 92 and 93, relative to the document, the operator knows when he has the system adjusted such that the entirety of the document is encompassed by the indicators and therefore will be transmitted to the document image area when he presses a "Make Copy" button.

As shown in FIG. 5, indicating pointers 91, 92 and 93 are operated by positioning motor 87 through cable 88, pulley 125 and cable 94. If pulley 95 is rotated in direction D, then cable 96 rotates to move positioning indicator 93 in a direction to encompass a larger and larger document. Similarly, positioning indicators 91 and 92 move apart from one another to encompass a larger document along the reference edge. The positioning indicators 91 and 92 may move at any selected ratio relative to position indicator 93 depending upon the nominal sizes of paper most frequently copied. For example, if $8\frac{1}{2} \times 11$-inch paper is the usual size to be copied, and if the reduction ratio at its maximum setting could copy two $8\frac{1}{2} \times 11$-inch documents, then positioning indicator 93 must move from an 11-inch mark to a 17-inch mark, while positioning indicators 91 and 92 need only move from $8\frac{1}{2}$ to 11 inches. However, the ratio of $8\frac{1}{2}$:11 must be maintained in order to copy the $8\frac{1}{2} \times 11$-inch size at 1:1 and therefore positioning indicators 91 and 92 are actually separated by 13.1 inches rather than 11 inches when indicator 93 is at the 17-inch mark. Therefore, while the indicators and all other adjustments in the system are capable of reducing 13.1-inch documents, it is probable that 11-inch documents are the maximum size required. Therefore, if desired, the document glass may be less than 13.1 inches, although the indicator movement may not be less than that amount.

Figure 6:
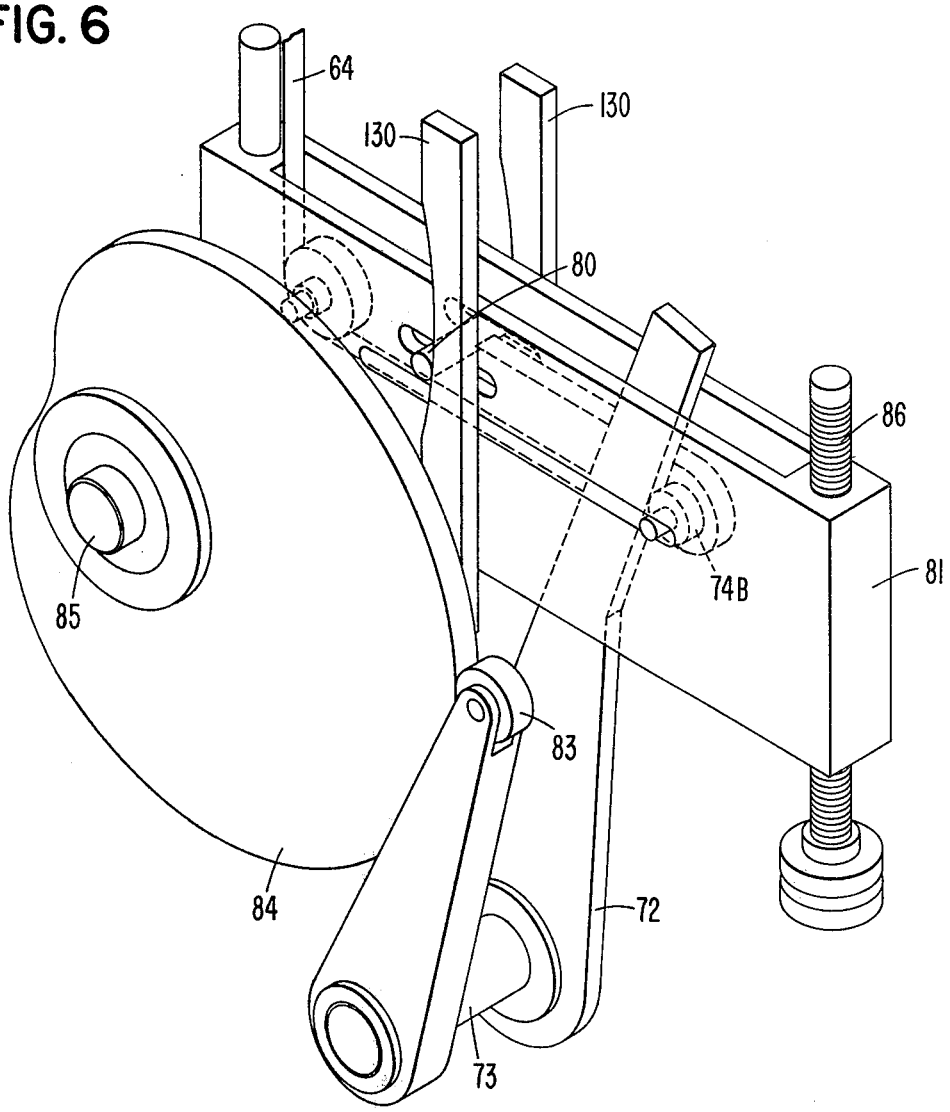
FIG. 6 shows another perspective of the optical drive system.

FIG. 6 is a detailed perspective view of the optics drive system. Truck 81 is shown mounted for vertical movement along lead screw 86. Movably mounted in truck 81 is drive carriage 74 to which drive cable 64 is attached by passing around a pulley 74B on the drive carriage to the adjustable ground point 80 on truck 81. For simplicity, the drive cable 65 is not shown and only pulley 74B of drive carriage 74 is shown.

During scan, drive carriage 74 is moved in a reciprocating manner in the truck 81 by the drive arm 72. Drive arm 72 is moved on its pivot point by shaft 73 under the influence of drive cam 84 and follower 83. Each 360° of drive cam rotation involves a movement of the scanning carriages in both a scan and a rescan direction. The shape of the cam 84 is such as to provide a constant velocity to the carriages as they move through the scan. Continuous variation in scan velocity is obtained by moving the truck 81 up and down the lead screw 86 which repositions the drive carriage 74 along drive arm 72 prior to scan. If the carriage 74 is positioned near the top of drive arm 72, the carriage 74 will be moved at a faster velocity through a greater distance by arm 72 than it would with the drive carriage 74 positioned near the bottom of drive arm 72. Thus, the velocity of the scan and the length of the scan are controlled by the velocity and the length of movement of drive carriage 74 which in turn is a result of the positioning of carriage 74 along arm 72.

Figure 8:
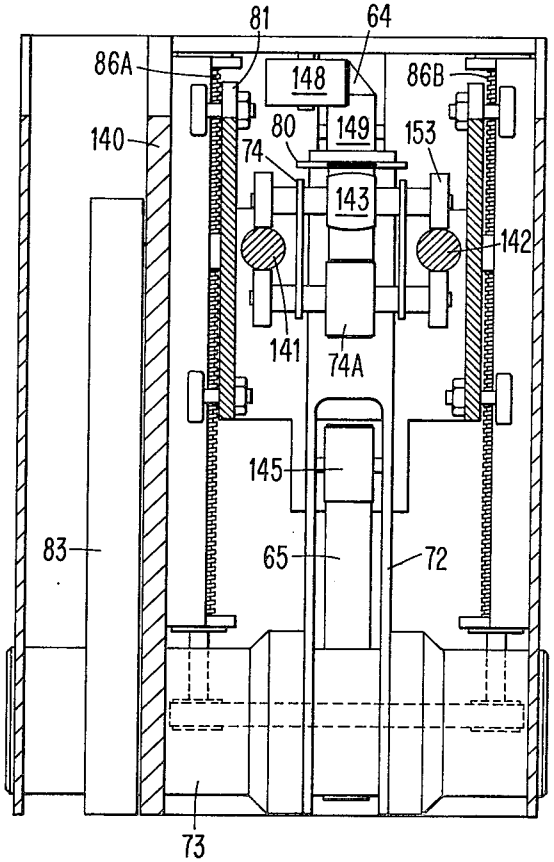
FIG. 8 is a sectional view taken along line 8—8 in FIG. 7.
Figure 7:
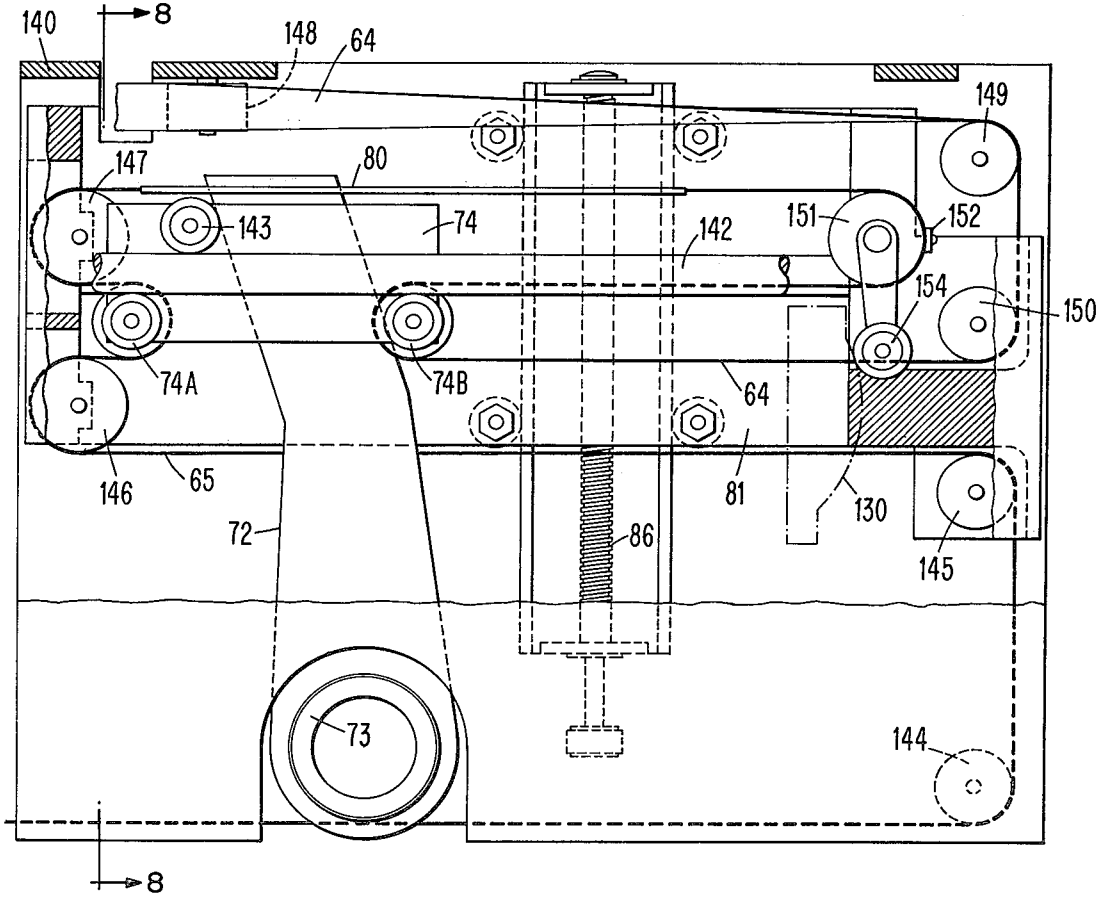
FIG. 7 shows a preferred embodiment of the optical drive system.

FIGS. 7 and 8 are views of a preferred embodiment of the optics drive system as it may be actually constructed. FIG. 8 is a sectional view taken along line 8—8 in FIG. 7.

Referring to FIG. 7, drive carriage 74 is shown with pulleys 74A and 74B at opposite ends thereof. Follower 143 is mounted on carriage 74 and provides the bearing surface for contact with drive arm 72. FIG. 8 shows that carriage 74 is mounted on parallel rails 141 and 142 by wheels such as 153. Rails 141 and 142 are mounted in truck 81 which is moved in a vertical direction by drive screws 86A and 86B. A housing 140 generally encloses truck 81 and provides structural support.

FIG. 7 also shows the path of drive cables 64 and 65. Drive cable 65 passes around pulley 144 mounted on stationary housing 140 and goes to pulley 145 and 146 which are mounted on the vertically movable truck 81. Cable 65 then passes around pulley 74A on drive carriage 74 and pulley 147 on truck 81 to the adjustable ground point 80. Cable 64 passes around pulleys 148 and 149 mounted on stationary housing 140 and goes to pulley 150 mounted on movable truck 81. Cable 64 then passes around pulley 74B on drive carriage 74 and pulley 151 on truck 81 to adjustable ground point 80.

Note that drive cable 64 is grounded by clamp 152 to pulley 151 and thereby to truck 81. Pulley 152 is rigidly connected to cam follower 154 which rides on locating cam 130. Thus, as the truck 81 is moved downwardly from the position shown in FIG. 7, clamp 152 is rotated in a counterclockwise direction. Such rotation adjusts the position of ground point 80, paying out cable 65 and taking in cable 64. Again, the significance of this adjustment will be described below.

Figure 9:
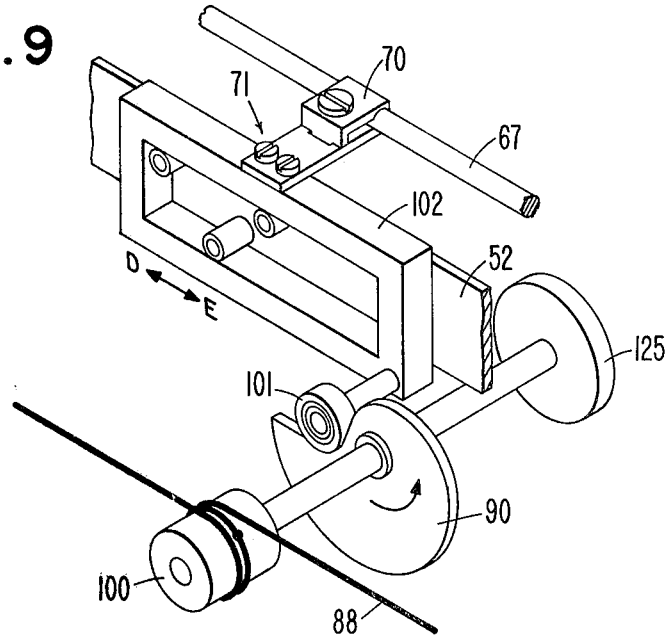
FIG. 9 is a perspective of the total conjugate length (TCL) adjusting mechanism.

FIG. 9 is a view of the TCL cam 90 which positions the movable ground point 71 to provide a total conjugate length adjustment. Cam 90 is driven from the optics positioning cable 88 which is wrapped around and attached to a drive pulley 100. Cam follower 101 is attached to the TCL truck 102 which is moved in a reciprocating manner in the directions D and E under the influence of cam 90. Note that truck 102 is positioned near the interior wall 52 shown also in FIG. 3. By moving the truck 102, a ground point 71 for the cable 67 is moved in the directions D and E. In referring again to FIG. 4, note that the cable 67 is the endless cable mounted on the arm of 66 of carriage 61. Attached to the endless cable 67 is the other scanning carriage 60. Thus, by moving the ground point 71 an adjustment is made to the distances between the carriages 60 and 61 prior to the start of a scan. In that manner, the distances between mirrors mounted on carriages 60 and 61 are adjusted, thus the total conjugate length is adjusted for different magnification ratios.

Figure 10:
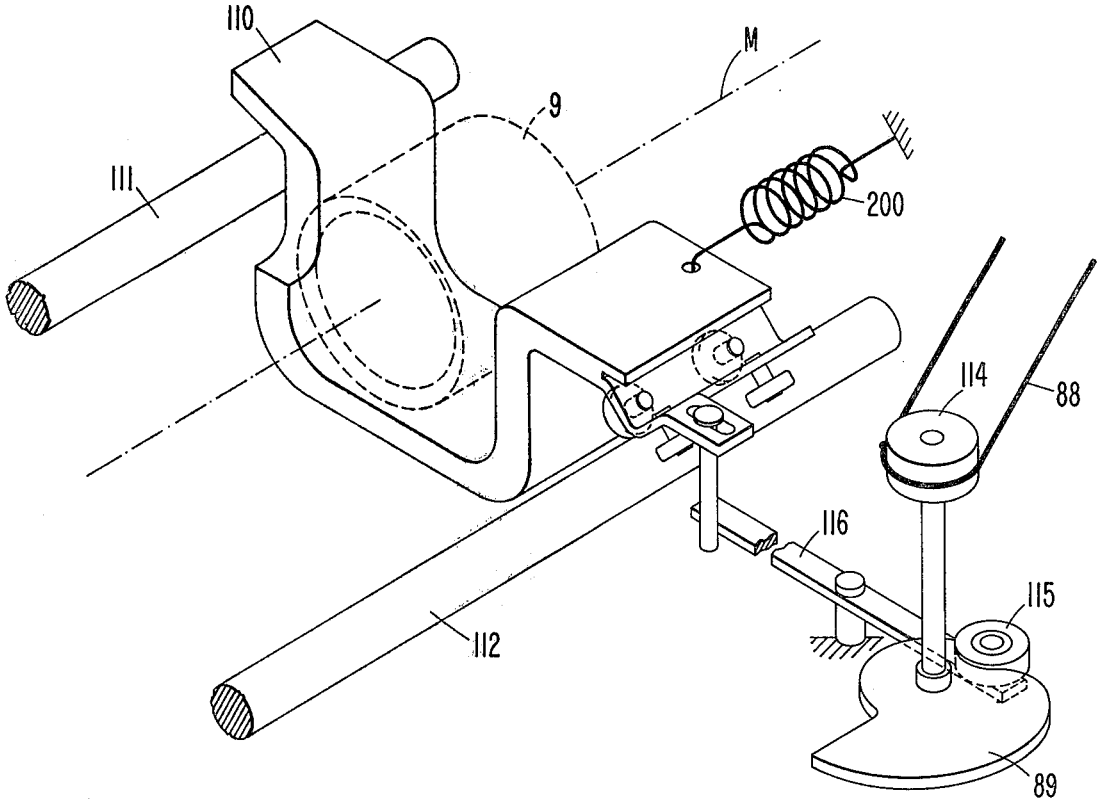
FIG. 10 shows the magnification adjustment mechanism together with the lens carriage.

FIG. 10 shows the lens 9, in phantom, mounted in lens carriage 110. The carriage 110 rides on rails 111 and 112 to carry the lens 9 along the magnification axis M. The carriage 110 is moved under the influence of magnification cam 89 which is positioned by the optics positioning cable 88 attached to drive pulley 114. Cam follower 115 is mounted upon a pivoted arm 116 which physically moves the lens mount 110. Spring 200 is attached to carriage 110 and biases it against arm 116. Thus, when the optics positioning motor 87, shown in FIG. 5, is rotated, the lens 9 is positioned through the optics positioning system, including drive cable 88, cam 89 and arm 116.

C. Operation of the Machine a. Keeping the TCL Constant During Scan

Mechanisms have been described hereinabove for adjusting the TCL (total conjugate length) to a particular value prior to scan depending upon the particular reduction ratio selected. Obviously, that TCL setting must remain constant throughout the scanning of the document and the two components of total conjugate length, the distance from the document glass to the lens and the distance of the lens to the image plane must also remain constant. However, note that as carriage 60, carrying the illumination lamp and the first reflecting mirror 46, moves across the document glass, the distance from mirror 46 to the lens 9 shortens, see FIG. 3, unless carriage 61 carrying reflectors 47 and 48 is moved away from the lens 9. Referring to FIG. 3, observe that as mirror 46 is moved toward the back of the machine mirrors 47 and 48 must also be moved toward the back of the machine and the ratio of movement must be at half the speed at which mirror 46 moves for the total distance from mirror 46 to lens 9 to remain constant. The reason is obvious since there are two mirrors 47 and 48 on carriage 61 moving away from lens 9, therefore the total path length as a result of the movements of those mirrors is twice that of the movement of mirror 46. Consequently, to maintain TCL as the scanning carriages move across the document glass, a system must be provided to move carriage 61 at half the speed of carriage 60.

Referring now to FIG. 4, it can be seen that the above-described motion is obtained by driving the slower moving carriage 61 through drive cables 64 and 65. The faster moving carriage 60 is connected along one side of an endless cable 67 between pulleys which are mounted on carriage 61. The opposite side of endless cable 67 is grounded at 71, thus providing a motion multiplier which moves the carriage 60 at twice the speed of carriage 61.

b. The Magnification Adjustment

Referring to FIG. 5, whenever positioning motor 87 is energized, the positioning indicators 91, 92 and 93 are moved to encompass the document placed on the document glass. To move these indicators, the operator simply operates a switch (not shown) which energizes motor 87, causing it to rotate until the operator signals stop. As the indicators move to encompass the document, so also the drive cable 88 moves magnification cam 89 to position the lens 9 at a magnification setting to copy the area of the document glass encompassed by the positioning indicators. Thus the lens 9 is always moved in synchronism with those indicators with the result that whatever the area encompassed by the indicators, the magnification is adjusted to place that area on a chosen image area, such as an $8\frac{1}{2}\times 11$-inch image area on the photoconductor drum. Again, the specific mechanism for moving the lens is shown in FIG. 10.

c. The TCL Adjustment

Referring again to FIG. 5, as the operator maintains motor 87 in rotation, drive belt 88 turns the TCL cam 90 which adjusts the ground point on endless cable 67 in order to change the TCL of the optical path between the document glass and the image plane. Details of the TCL cam are shown on FIG. 9, but the operation can best be explained with reference to FIG. 4.

The TCL cam adjusts the position of ground point 71. Suppose that the adjustment to the ground point is made in direction F. When that happens, carriage 61 remains stationary, but carriage 60, which is rigidly attached to endless cable 67 through clamp 69, is moved toward carriage 61. In that manner, the TCL is shortened prior to the start of scan. Similarly, if ground point 71 is moved by the TCL cam in direction G, the carriage 60 will be moved further away from carriage 61, thus increasing the TCL. In that manner, TCL is adjusted for every reduction ratio in a continuous manner so that whatever the reduction ratio selected, focal sharpness at the image plane is maintained.

Referring again to FIG. 5, note that the rotation of the TCL cam is performed by energization of motor 87 and thus the TCL is adjusted in synchronism with the magnification adjustment so that whatever the document area encompassed by the positioning indicators 91, 92 and 93, the magnification and focal sharpness are adjusted accordingly.

d. Adjustment of the Speed and Length of Scan

As previously described, when scanning a large document, and reducing it to put it on a relatively small image area, the scan must move at a greater velocity over a greater length in order to accomplish the scan in the proper length of time. Referring again to FIG. 5, note that as optics positioning motor 87 is energized, truck 81 is moved along lead screw 86. Drive carriage 74 moves with the truck 81 and is biased against drive arm 72 by the tensioning spring 75 (shown in FIG. 4). Thus, as drive carriage 74 is positioned at the top of drive arm 72, and arm 72 is then moved in direction B according to the dictates of cam 84, the drive carriage 74 is moved at a relatively fast speed over a relatively long distance. However, if drive carriage 74 has been positioned near the bottom of drive arm 72, then the same motion of arm 72 results in a slower velocity movement of drive carriage 74 in direction B and it also moves through a much shorter distance. Since drive cable 64 is connected around pulley 74B on drive carriage 74, it is moved at a velocity and through a distance directly proportional to the velocity and distance through which drive carriage 74 is moved. Since cable 64 is directly connected to scan carriage 61, that carriage is moved at a velocity and through a distance proportional to the movement of drive carriage 74. And since carriage 60 is connected through endless cable 67 to the driven scan carriage 61, scan carriage 60 is also controlled by the distance and the speed of movement of drive carriage 74.

Note that as drive carriage 74 is moved down the arm 72, drive cable 64 is paid out, thus adjusting the starting position of scan carriages 60 and 61. This will be further discussed below.

Note also that the adjustment of the position of drive carriage 74 is due to the rotation of optics positioning motor 87 and is performed in synchronism with the adjustments for magnification and TCL.

e. The Leading Edge Adjustment

Figure 11:
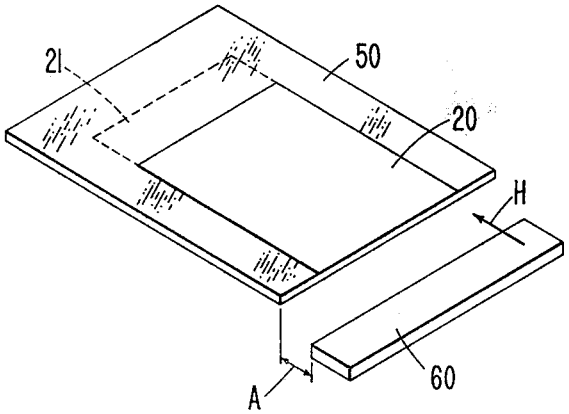
FIGS. 11 and 11*a* are diagrams for use in explaining leading edge adjustment.

As previously discussed, it is necessary to adjust some part of the optical system to ensure that the leading edge of the document is always laid down upon the leading edge of the image area, regardless of the magnification ratio selected. This problem is most easily understood through reference to FIG. 11 where document glass 50 is shown with document 20 and larger document 21 positioned thereon. Carriage 60 carrying the illumination lamp is shown positioned at a distance A from the leading edge of the document 20 (assuming that the scanning direction of carriage 60 is as shown by arrow H).

Figure 11A:
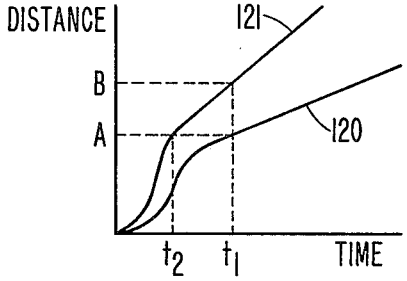

In FIG. 11*a*, which is a graph of the distance traveled by carriage 60 against the time it takes to travel that distance, for the curve 120 (which is a graph of the velocity of carriage 60 when it is called upon to scan document 20) the carriage 60 moves a distance A in the time $t_1$. By the time $t_1$, the carriage is moving at a constant velocity as represented by the linear slope of line 120 and thus moves across document 20 at the proper constant speed. However, for slope 121 the carriage 60 moves the distance a in the time $t_2$. (Curve 121 is a graph of the velocity of carriage 60 when it is called upon to scan larger document 21.) The constant velocity of scan carriage 60 is greater for curve 121 since it must scan the document 21 in the same length of time that document 20 was scanned, and, as a result, the acceleration is greater as shown on FIG. 11*a* and thus distance A is travelled in a shorter length of time. Assuming the scan for both curves 120 and 121 start at the same point in the drum cycle, the result is that the starting point of the scan, i.e., when the line of light first begins to scan across the document, occurs earlier in the rotative cycle of the drum for the larger document than it did for the smaller document. As a result, the leading edge of the image of document 21 is laid down on the drum sooner than it was when scanning document 20. As previously noted, this would bring the leading edge of the larger document 21 outside of the image area and some portion of that document would not be copied onto the copy paper.

The particular solution to this problem adopted in the preferred embodiment of this machine is to adjust the starting position of scan carriage 60 such that it travels a distance B (refer to FIG. 11*a*) before reaching the leading edge of document 21. In that manner, the time $t_1$ for beginning the scan of the documents is the same regardless of the document size being copied. Other solutions to this problem could involve adjusting the time at which the scan carriages are started and could involve the provision of a scanning carriage with such low inertia that the distance A and the distance B could both be reduced to approximate zero. A possible solution for some configurations could involve shifting the image by shifting the position of the lens.

The particular mechanism for adjusting the starting point of the scanning carriage in the preferred embodiment of the invention is best seen with reference to FIGS. 6 and 7. As noted above, where drive carriage 74 is moved vertically along arm 72, drive cable 64 is taken up or paid out. In that manner, the starting position of scanning carriages 60 and 61 is changed with the magnification ratio selected. However, in order to fine adjust those starting points, the drive belt 64 is connected to an adjustable ground point 80 which is movable with reference to cam surface 130 as the truck 81 is moved along lead screw 86. Therefore, as the ground point 80 is shifted the drive cable 64 is caused to be either taken up or paid out an additional small amount, with the result that the starting point of the two carriages 60 and 61 is adjusted. Consequently, a system has been provided for adjusting the starting point of the scan carriages in a continuous manner through the action of an optics positioning motor 87.

The above-described mechanisms allow for adjusting the starting point of the scan carriages in synchronism with the magnification adjustment, the TCL adjustment and the adjustment of the speed and length of scan and also, of course, in conjunction with the movement of positioning indicators 91, 92 and 93. In that manner, all adjustments which must be made prior to scan are made through the energization of one positioning motor and all adjustments are tied together to provide correct settings for all variables prior to scan. Furthermore, these adjustments are all organized to operate in a continuous fashion so that a continuously variable reduction machine is provided, operating between the boundaries set by the particular mechanisms chosen in a particular machine embodiment.

D. A Second Preferred Embodiment

Another embodiment of this invention is practiced by replacing the fixed focus lens 9 with a variable focus (zoom) lens. In such a system, the various figures shown for the preferred embodiment remain unchanged except that the TCL cam, the magnification cam, and the associated adjusting mechanisms are either eliminated or altered and a mechanism for adjusting the variable focus lens elements is added.

With respect to the TCL adjustment and with reference to FIG. 9, the pulley 100 drives pulley 125 for moving the reduction indicators while moving ground point 71 is made into a stationary ground point by rigid connection to wall 52. The cam 90, the cam follower 101 and the linearly moving truck 102 are eliminated. With reference to FIG. 5, the cam 90 is eliminated by the remainder of the system as illustrated is unchanged.

With respect to magnification, the variable focus lens system may take two forms. In one form, the system is unchanged except that the shape of the magnification cam is altered to move the lens 9 along the rails 111 and 112 in accordance with the needs of the particular variable focus lens chosen. That is to say, for a particular reduction ratio, the interior movement of lens elements within the lens barrel provide for most of the needed change in magnification. However, some physical movement of the lens along the optical axis M may also be necessary to accomplish the needed change in magnification ratio. Thus, a differently shaped cam 89, matched to the variable focus lens 9, is used. Otherwise, FIG. 10 remains the same.

In a second form of the variable focus lens system, all of the needed change in reduction ratio is accomplished by the interior movement of lens elements. In this case, the lens 9 is fastened to a stationary mount, thus eliminating the magnification cam 89 and all of the associated adjusting mechanisms shown in FIG. 10. In fact, all of FIG. 10 is removed from the machine except for lens 9.

A mechanism for adjusting the interior lens elements to change the magnification ratio is necessary for both forms of the variable focus lens embodiment. Since standard variable focus lenses are adjusted by a simple rotation of the lens barrel, such a mechanism is added to FIG. 10 by cutting a slot in the mount for the lens, such as a slot in carriage 110, extending an arm rigidity fastened to the lens barrel through the slot, and moving the arm from a variable focus cam driven by drive cable 88.

E. Other Applications

It should be recognized that the principles of this invention can be applied to other systems. For example, the specific two embodiments described above call for a stationary object plane and a stationary image plane and adjust for changes in TCL by using mirrors in a folded optical system or by using a variable focus lens. However, it is possible to utilize the inventive principles herein in a machine where the object plane, for example, is moved for the TCL adjustment. To provide a continuously variable system, such movement could be successfully accomplished from a cam or from a variable pitch leadscrew.

Also, the two specific embodiments described above utilize a scanning mirror system for moving a line of light across the stationary document. However, it is well known in the prior art to provide a moving document platen, moving past a stationary illuminating line of light as discussed above with reference to FIG. 2*a*. The principles of this invention are applied to such a system by connecting the drive cables to a document carriage and making mirror 46 stationary. All other components of the system would be unaffected except for the TCL adjustment which would be made by moving mirrors 47 and 48 by the TCL cam. Even that change can be eliminated by using a variable focus lens embodiment as described above.

Another variation known in the prior art to which this invention may be applied is to use a scanning lens in place of the scanning mirrors. In this case, the document is usually stationary and a line of light is moved across the document. Mirrors 46, 47 and 48 are eliminated so that the light is directed to the lens 9 which moves with the line of light; lens 9 could be a fixed focus or a variable focus lens. Such a system would, however, require a rather complete reconstruction of the embodiment shown herein.

While the principles of the invention have been described in connection with electrophotographic copier machines, the invention may also be applied in other areas, such as facsimile, and it is to be clearly understood that this description if made only by way of example and not as a limitation to the scope of the invention as set forth in the objects thereof and in the accompanying claims.

What is claimed is:

1. A continuously variable reduction imaging system for an electrophotographic copier machine, wherein a document to be copied is typically of rectangular shape, comprising:

a glass platen upon which said document to be copied is placed;

a mount for carrying photoreceptive material;

main motive means for moving said mount;

a source of illumination;

a document scanning system comprised of a scanning carriage for traversing said document and directing illumination from said source to said document;

means for driving said scanning carriage;

an optics system for direction illumination from said document to produce an image on said photoreceptive material, said optics system including a lens; and an optics positioning system including means for adjusting said lens to continuously variable settings in a continuously variable manner to achieve any desired magnification ratio between two boundaries and including locating means for maintaining the reference edge of the document at a constant position on the image plane regardless of the continuously settable magnification ratio selected.

2. The imaging system of claim 1, further including means for adjusting the focal sharpness of said optics system in a continuous manner so that whatever the magnification ratio selected, the image remains sharp.

3. The imaging system of claim 2 wherein said means for adjusting focal sharpness include movable reflective surfaces arranged to fold the optical path of said illumination.

4. The imaging system of claim 3 wherein said lens in a single focus lens, wherein said glass platen is located in a stationary document plane, wherein said image is produced on said photoreceptive material in a stationary image plane, and wherein said movable reflective surfaces adjust the length of the optical path in a continuous manner so that the image remains sharp on said stationary image plane despite changes in the magnification ratio.

5. The imaging system of claim 4 including magnification cam means for adjusting the position of said lens, according to a command from said optics positioning system.

6. The imaging system of claim 5 wherein said document scanning system is further comprised of two scanning carriages, one of which carries two mirrors, in directing the illumination from said document to said photoreceptive material, one of said scanning carriages driven during scan at half the speed of the other carriage.

7. The imaging system of claim 6 wherein said means for driving said scanning carriage is directly connected to the slower moving of the two scanning carriages, and the faster carriage is driven by connection to the slower carriage.

8. The imaging system of claim 7 wherein the focal sharpness adjustment comprises means for adjusting the optical path distance between the two scanning carriages prior to scan start, said means including a focal sharpness cam through which a cam follower is positioned according to a command from said optics positioning system according to the magnification ratio selected.

9. The imaging system of claim 8 wherein said locating means comprises a locating cam for adjusting the start position of said two carriages, said locating cam being positioned by said optics positioning system in accordance with the magnification ratio selected.

10. The imaging system of claim 9 wherein said driven scanning carriage is driven at a constant speed, said constant speed being variably adjustable in a continuous manner in accordance with the magnification ratio selected.

11. The imaging system of claim 10 wherein said scanning carriage for directing illumination to said document is moved a distance to start and complete the scan of said document in a fixed time interval, and wherein said distance is continuously adjustable in accordance with the magnification ratio selected.

12. The imaging system of claim 11 further including a reciprocating drive arm, a drive carriage located for movement with said arm, a drive cable connected to said drive carriage and said driven scanning carriage, a truck in which said drive carriage is mounted, and means for positioning said truck such that said drive carriage is positioned in a continuously variable manner along said drive arm by said optics positioning system, whereby the speed and length of scan is set in accordance with the magnification ratio selected.

13. The imaging system of claim 12 wherein said optics positioning system includes an adjusting motor, means connected to said adjusting motor for driving said truck, driving said magnification cam, and driving said focal sharpness cam.

14. The imaging system of claim 13 including a locating cam follower means mounted for movement with said truck.

15. The imaging system of claim 14 wherein said drive arm is driven from a drive cam connected to said main motive means.

16. A continuously variable reduction imaging system comprising:

a stationary, glass platen;

a source of illumination;

a scanning system comprised of a scanning carriage for traversing said platen and directing illumination from said source to said platen;

driving means for moving said scanning carriage at a constant speed across said platen;

an optics system for directing illumination from said platen to an image plane, said optics system including a lens, and an optics positioning system, including means for adjusting said lens to continuously variable settings to achieve any desired magnification ratio between two boundaries, means for continuously setting the scan distance of said scanning carriage in accordance with the selected magnification ratio, and means for adjusting the magnitude of said constant speed to continuously variable settings in accordance with the selected magnification ratio.

17. The imaging system of claim 16 further including locating means for maintaining the reference edge of the document at a constant position on the image plane regardless of the selected magnification ratio.

18. The imaging system of claim 17 wherein said means for adjusting focal sharpness include movable reflective surfaces arranged to fold the optical path of said illumination.

19. The imaging system of claim 18 wherein said lens is a single focus lens, wherein said glass platen is located in a stationary document plane, wherein said image is produced on said photoreceptive material in a stationary image plane, and wherein said movable reflective surfaces adjust the length of the optical path in a continuous manner so that the image remains sharp on said stationary image plane despite changes in the magnification ratio.

20. The imaging system of claim 19 further including a reciprocating drive arm, a drive carriage located for movement with said arm, a drive cable connected to said drive carriage and said driven scanning carriage, a truck in which said drive carriage is mounted, and means for positioning said truck such that said drive carriage is positioned in a continuously variable manner along said drive arm by said optics positioning system, whereby the speed and length of scan is set in accordance with the magnification ratio selected.

21. The imaging system of claim 20 including magnification cam means for adjusting the position of said lens, according to a command from said optics positioning system.

22. The imaging system of claim 21 wherein the focal sharpness adjustment comprises means for adjusting the optical path distance prior to scan start, said means including a focal sharpness cam through which a cam follower is positioned according to a command from said optics positioning system according to the magnification ratio selected.

23. The imaging system of claim 22 wherein said locating means comprises a locating cam for adjusting the start position of said scanning carriage, said locating cam being positioned by said optics positioning system in accordance with the magnification ratio selected.

24. The imaging system of claim 23 wherein said optics positioning system includes an adjusting motor, means connected to said adjusting motor for driving said truck, driving said magnification cam, and driving said focal sharpness cam.

* * * * *